US010731090B2

(12) United States Patent
Pahwa et al.

(10) Patent No.: US 10,731,090 B2
(45) Date of Patent: Aug. 4, 2020

(54) PROCESS AND APPARATUS FOR TREATING MERCAPTANS

(71) Applicant: UOP LLC, Des Plaines, IL (US)

(72) Inventors: Piyush Pahwa, Delhi (IN); Amit Munjal, Haryana (IN)

(73) Assignee: UOP LLC, Des Plaines, IL (US)

( * ) Notice: Subject to any disclaimer, the term of this patent is extended or adjusted under 35 U.S.C. 154(b) by 184 days.

(21) Appl. No.: 16/045,351

(22) Filed: Jul. 25, 2018

(65) Prior Publication Data

US 2018/0327674 A1 Nov. 15, 2018

Related U.S. Application Data

(63) Continuation of application No. PCT/US2017/026781, filed on Apr. 10, 2017.

(60) Provisional application No. 62/322,732, filed on Apr. 14, 2016.

(51) Int. Cl.

| | |
|---|---|
| ***C10G 27/04*** | (2006.01) |
| ***C10G 61/04*** | (2006.01) |
| ***C10G 27/06*** | (2006.01) |
| ***C10G 53/14*** | (2006.01) |
| ***C10G 19/02*** | (2006.01) |
| ***C10G 35/14*** | (2006.01) |

(52) U.S. Cl.

CPC ..... *C10G 61/04* (2013.01); *C10G 19/02* (2013.01); *C10G 27/04* (2013.01); *C10G 27/06* (2013.01); *C10G 35/14* (2013.01); *C10G 53/14* (2013.01); *C10G 2300/104* (2013.01); *C10G 2300/1044* (2013.01); *C10G 2300/202* (2013.01); *C10G 2400/02* (2013.01); *C10G 2400/04* (2013.01)

(58) Field of Classification Search

CPC ..... C10G 19/00; C10G 19/02; C10G 27/04; C10G 27/06; C10G 35/14; C10G 61/04; C10G 53/12; C10G 53/14; C10G 65/06

See application file for complete search history.

(56) References Cited

U.S. PATENT DOCUMENTS

| | | | | |
|---|---|---|---|---|
| 5,039,398 | A * | 8/1991 | Stine | C10G 27/10 208/189 |
| 5,599,441 | A | 2/1997 | Collins et al. | |
| 9,074,145 | B2 | 7/2015 | Hoehn et al. | |
| 9,079,118 | B2 | 7/2015 | Zhu et al. | |
| 2004/0188327 | A1 | 9/2004 | Groten | |
| 2005/0252831 | A1* | 11/2005 | Dysard | C10G 45/08 208/212 |
| 2015/0014218 | A1* | 1/2015 | Bisht | C10G 65/06 208/97 |
| 2016/0115393 | A1* | 4/2016 | Smith | C10G 33/06 208/203 |

(Continued)

OTHER PUBLICATIONS

PCT Search Report dated Jul. 20, 2017 for corresponding PCT Application No. PCT/US2017/026781.

*Primary Examiner* — Michelle Stein

(57) ABSTRACT

Processes and apparatuses are disclosed for treating a naphtha stream from a FCC unit comprising passing the naphtha stream to a naphtha splitter column to provide a light naphtha stream and a heavy naphtha stream. The light naphtha stream is reacted in a mercaptan oxidation reactor to provide a demercaptanized naphtha stream. The demercaptanized naphtha stream is stripped in a light stripper column to provide a treated light naphtha stream and a bottoms stream.

14 Claims, 1 Drawing Sheet

(56) References Cited

U.S. PATENT DOCUMENTS

2016/0145502 A1* 5/2016 Koseoglu ..... C10G 27/06
423/574.1

* cited by examiner

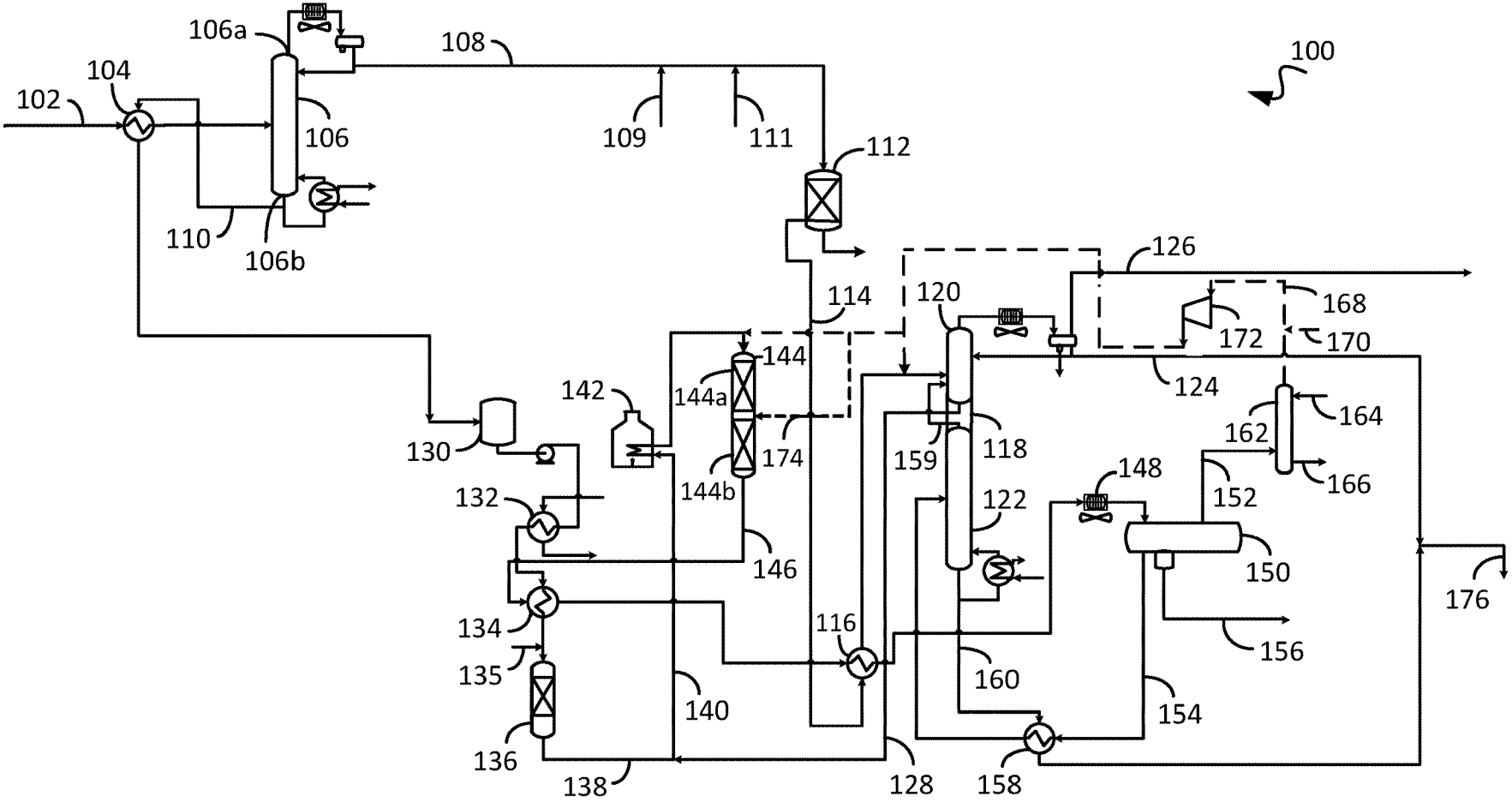
100
102
104
106
106a
106b
108
109
110
111
112
114
116
118
120
122
124
126
128
130
132
134
135
136
138
140
142
144
144a
144b
146
148
150
152
154
156
158
159
160
162
164
166
168
170
172
174
176

PROCESS AND APPARATUS FOR TREATING MERCAPTANS

CROSS-REFERENCE TO RELATED APPLICATIONS

This application is a Continuation of copending International Application No. PCT/US2017/026781 filed Apr. 10, 2017, which application claims priority from U.S. Provisional Application No. 62/322,732 filed Apr. 14, 2016, now expired, the contents of which cited applications are hereby incorporated by reference in their entirety.

TECHNICAL FIELD

The technical field generally relates to processes and apparatuses for treating petroleum fractions. More particularly, the technical field relates to an improved process and apparatus for removing sulfur from petroleum fractions such as naphtha.

BACKGROUND

Sweetening of petroleum fractions, such as naphtha boiling range hydrocarbons or other liquid hydrocarbons, which contain mercaptans, also known as sour petroleum fractions, are well-developed commercial processes commonly used in many petroleum refineries. In the sweetening process, mercaptans contained in the feed hydrocarbon stream, sour hydrocarbon stream, are catalytically oxidized to disulfide compounds that remain in the hydrocarbon stream, sweetened hydrocarbon stream. Sweetening processes, therefore, typically do not remove sulfur from the hydrocarbon stream but rather convert the sulfur to an acceptable, non-odorous form. The sweetening process involves admixing an oxygen-containing stream to the sour hydrocarbon stream to supply the required oxygen. The admixture of hydrocarbons and oxygen contacts an oxidation catalyst in an aqueous alkaline environment to oxidize the mercaptans in a mercaptan oxidation unit.

In a typical configuration for the sweetening of full range naphtha from a fluid catalytic cracking (FCC) unit, the mercaptan oxidation unit is located upstream of a naphtha splitter column for conversion of mercaptants to disulfides, so that the disulfides are hydrotreated in a downstream process. However, the current approach requires the temperature of incoming naphtha feed from the FCC unit to the mercaptan oxidation unit to be reduced to achieve appropriate reaction conditions in the mercaptan oxidation unit. The treated effluent from the mercaptan oxidation reactor is again required to be heated before being fed to the naphtha splitter column and hence resulting in inefficient heat management.

Further, in a conventional flow scheme, air is injected at the inlet of the mercaptan oxidation unit for oxidation of mercaptans to disulfides. The amount of injected air is almost 200% higher than the theoretically stoichiometrically required amount, and remains dissolved in the effluent from the mercaptan oxidation unit. Removal of dissolved oxygen is very important for protection of equipment against corrosion and fouling. The design of the naphtha splitter becomes complicated and results in an increase in capital expense because the oxygen has to be purged from the system.

Accordingly, it is desirable to provide processes and apparatuses for the oxidation of mercaptans contained in a feed stream that includes liquid hydrocarbons such as naphtha boiling range hydrocarbons or the like for forming a sweetened hydrocarbon stream with efficient heat management. Additionally, it is desirable to provide processes and apparatuses for the oxidation of mercaptans having a simpler naphtha splitter design at a lower capital expense. Furthermore, other desirable features and characteristics of the present invention will become apparent from the subsequent detailed description and the appended claims, taken in conjunction with the accompanying FIGURE and this background.

BRIEF SUMMARY

Various embodiments contemplated herein relate to processes and apparatuses for sweetening of naphtha boiling range hydrocarbons. The exemplary embodiments taught herein provide an improved process and apparatus for sweetening of naphtha boiling range hydrocarbons.

In accordance with an exemplary embodiment, a process is provided for treating a naphtha stream from a FCC unit comprising reacting a light naphtha stream in a mercaptan oxidation reactor to provide a demercaptanized naphtha stream. The demercaptanized naphtha stream is stripped in a light stripper column to provide a treated light naphtha stream and a bottoms stream.

In accordance with another exemplary embodiment, a process is provided for treating a naphtha stream from a FCC unit comprising passing the naphtha stream to a naphtha splitter column to provide a light naphtha stream and a heavy naphtha stream. The light naphtha stream is reacted in a mercaptan oxidation reactor to provide a demercaptanized naphtha stream. The demercaptanized naphtha stream is stripped in a light stripper column to provide a treated light naphtha stream and a bottoms stream.

In accordance with yet another exemplary embodiment, an apparatus is provided for treating a naphtha stream from a FCC unit comprising a mercaptan oxidation reactor to provide a demercaptanized naphtha stream. A light stripper column is in downstream communication with the mercaptan oxidation reactor to provide a light stripper bottoms stream.

It is an advantage to have a naphtha splitter column upstream of a mercaptan oxidation reactor as the mercaptan oxidation reactor can be smaller in size because it will be handling light naphtha only instead of full range naphtha. Further, the scheme would be energy efficient because cooling of incoming naphtha from the FCC unit to the mercaptan oxidation reactor and the subsequent heating of the effluent to the naphtha splitter column will not be required. Moreover, an embodiment of a stacked stripper arrangement comprising the light stripper column and the heavy stripper column will be a smaller column resulting in savings in capital expense. These and other features, aspects, and advantages of the present invention will become better understood upon consideration of the following detailed description, FIGURE and appended claims.

BRIEF DESCRIPTION OF THE DRAWING

The various embodiments will hereinafter be described in conjunction with the FIGURE, wherein like numerals denote like elements.

The FIGURE is a flow scheme for the process and apparatus of the present invention.

Definitions

As used herein, the term "stream" can include various hydrocarbon molecules and other substances.

The notation "Cx" means hydrocarbon molecules that have "x" number of carbon atoms, Cx+ means hydrocarbon molecules that have "x" and/or more than "x" number of carbon atoms, and Cx− means hydrocarbon molecules that have "x" and/or less than "x" number of carbon atoms.

As used herein, the term "overhead stream" can mean a stream withdrawn at or near a top of a vessel, such as a column.

As used herein, the term "bottoms stream" can mean a stream withdrawn at or near a bottom of a vessel, such as a column.

As depicted, process flow lines in the FIGURE can be referred to interchangeably as, e.g., lines, pipes, feeds, gases, products, discharges, parts, portions, conduits or streams.

As used herein, the term "mercaptan" typically means a thiol and may be used interchangeably therewith, and can include compounds of the formula R—SH as well as salts thereof, such as mercaptides of the formula RS-M+ where R is a hydrocarbon group, such as an alkyl or aryl group, that is saturated or unsaturated and optionally substituted, and M is a metal, such as sodium or potassium.

As used herein, the term "disulfides" can include dimethyldisulfide, diethyldisulfide, and ethylmethyldisulfide, and possibly other species having the molecular formula RSSR' where R and R' are each, independently, a hydrocarbon group, such as an alkyl or aryl group, that is saturated or unsaturated and optionally substituted. Typically, a disulfide is generated from the oxidation of a mercaptan-tainted caustic and forms a separate hydrocarbon phase that is not soluble in the aqueous caustic phase.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top or overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise shown. Stripping columns omit a reboiler at a bottom of the column and instead provide heating requirements and separation impetus from a fluidized inert media such as steam.

The term "predominantly" means a majority, suitably at least 80 wt % and preferably at least 90 wt %.

As used herein, the term "T5" or "T95" means the temperature at which 5 volume percent or 95 volume percent, as the case may be, respectively, of the sample boils using ASTM D-86.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description. The FIGURE has been simplified by the deletion of a large number of apparatuses customarily employed in a process of this nature, such as vessel internals, temperature and pressure controls systems, flow control valves, recycle pumps, etc. which are not specifically required to illustrate the performance of the invention. Furthermore, the illustration of the process of this invention in the embodiment of a specific drawing is not intended to limit the invention to specific embodiments set out herein.

An embodiment of a process for sweetening of petroleum fractions is addressed with reference to a process and apparatus 100 as shown in the FIGURE. The process and apparatus 100 includes a naphtha splitter column 106, a mercaptan oxidation reactor 112, a light stripper column 120, a heavy stripper column 122, a surge drum 130, a di-olefin saturation reactor 136, a hydrodesulfurization reactor 144, a separator 150 and an amine scrubber 162. In accordance with an exemplary embodiment as shown in the FIGURE, both the light stripper column 120 and the heavy stripper column 122 may be stacked in a single vessel 118.

In accordance with an exemplary embodiment as shown in the FIGURE, a hydrocarbon feedstream in line 102 comprising liquid hydrocarbons such as naphtha boiling range hydrocarbons and/or the like, for example naphtha boiling range hydrocarbons having a T5 temperature range between about 30° C. (86° F.) and about 60° C. (140° F.) and a T90 temperature range between about 60° C. (140° F.) and about 200° C. (392° F.), may be passed to the naphtha splitter column 106. In accordance with the instant embodiment as discussed, the hydrocarbon feedstream in line 102 is a naphtha stream and hence interchangeably referred to as naphtha stream in line 102. In an aspect, the naphtha stream in line 102 may be a full range naphtha stream from a FCC unit. In such an aspect, the naphtha splitter column 106 may be in downstream communication with a FCC column (not shown). The naphtha stream in line 102 may pass through a heat exchanger 104 to heat the naphtha stream by heat exchange with a heavy naphtha stream in a naphtha splitter bottoms line 110 before being fed to the naphtha splitter column 106.

During operation, the naphtha stream in line 102 may be passed to the naphtha splitter column 106 in which it is fractionated to provide a light naphtha stream in a naphtha splitter overhead line 108 and a heavy naphtha stream in an naphtha splitter bottoms line 110. In accordance with an exemplary embodiment as shown in the FIGURE, the light naphtha stream, typically a $C_5$-$C_6$ or a $C_5$-$C_7$ stream may be recovered from an overhead outlet **106*a* comprising the lighter outlet in the naphtha splitter overhead line 108. An overhead stream from the naphtha splitter column 106 may be condensed and separated in a receiver with a portion of the condensed liquid being refluxed back to the naphtha splitter column 106 to obtain the light naphtha stream from a net portion in the naphtha splitter overhead line 108. The heavy naphtha stream may be taken from the bottoms outlet comprising a heavy outlet 106***b* in the naphtha splitter bottoms line 110 typically comprising $C_{7+}$ naphtha. The heavy outlet 106*b* may be located in the column below the lighter outlet 106*a*. The naphtha splitter column 106 may be operated with a top pressure of about 69 to about 448 kPa (gauge) (10 to 65 psig) and a bottom temperature of about 121° C. to about 232° C. (250° F. to 450° F.). In an aspect, the naphtha splitter column 106 may be operated at a vacuum. In accordance with an exemplary embodiment as shown in the FIGURE, the heavy naphtha stream in heavy naphtha splitter bottoms line 110 may be passed to the heat exchanger 104 for heat exchange with the naphtha stream in line 102 to cool the heavy naphtha stream before being processed in the downstream processes. As illustrated, the naphtha splitter column 106 may include a reboiler at a bottom of the column to vaporize and send a portion of the heavy naphtha stream back to the bottom of the column.

The light naphtha stream in naphtha splitter overhead line 108 may be passed to the mercaptan oxidation reactor 112. Accordingly, the mercaptan oxidation reactor 112 may be in downstream communication with the naphtha splitter column 106. In accordance with an exemplary embodiment as shown in the FIGURE, the mercaptan oxidation reactor 112 may be in downstream communication with naphtha splitter overhead line 108. In an aspect, the mercaptan oxidation reactor 112 may be in direct, downstream communication with the naphtha splitter overhead line 108.

In accordance with the exemplary embodiment, the light naphtha stream may undergo reaction in the mercaptan oxidation reactor 112 to provide a demercaptanized naphtha stream in line 114. In the instant embodiment, the mercaptan oxidation reactor 112 comprises a mercaptan catalyst bed for contacting the light naphtha stream with an alkaline stream over a mercaptan oxidation catalyst in the presence of oxygen at reaction conditions effective to oxidize the mercaptans to disulfide compounds. The mercaptan oxidation reaction produces an alkaline-containing, sweetened naphtha stream that contains the disulfide compounds. An alkaline stream in line 109 is continuously injected into the light naphtha stream in line 108 along with air stream in line 111 before being fed to the mercaptan oxidation reactor 112. In accordance with an exemplary embodiment, the alkaline stream in line 109 and the air stream in line 111 may be passed to an inlet of the mercaptan oxidation reactor 112. Accordingly, the mercaptan oxidation reactor 112 may be in downstream communication with the alkaline stream in line 109.

The alkaline stream in line 109 may include caustic or ammonia. In an aspect, a dilute aqueous alkaline solution may be injected into the light naphtha stream in the naphtha splitter overhead line 108. The light naphtha stream in the naphtha splitter overhead line 108 may be passed downwardly through the fixed catalyst beds of the mercaptan oxidation reactor 112 in which the mercaptans are oxidized to disulfides. The disulfides, being oil soluble, remain in the hydrocarbon (naphtha) phase.

The mercaptan oxidation catalyst may include the active catalyst component(s) impregnated on a solid material particulate. The catalyst may comprise a metal compound of tetrapyridino-porphyrazine or a metallic phthalocyanine retained on an inert granular support. The metal(s) of the metallic phthalocyanine may be titanium, zinc, iron, manganese, cobalt, and/or vanadium. The metal phthalocyanine may be employed as a derivative compound. Commercially available sulfonated compounds such as cobalt phthalocyanine monosulfonate, cobalt phthalocyanine disulfonate, and/or other mono-, di-, tri-, and tetra-sulfo derivatives may also be employed as the mercaptan catalyst. Other derivatives including carboxylated derivatives, as prepared by the action of trichloroacetic acid on the metal phthalocyanine, can also be used as the mercaptan catalyst. The inert granular support may be in the form of tablets, extrudates, spheres, or randomly shaped naturally occurring pieces. Natural materials such as clays and silicates or refractory inorganic oxides may be used as the support material. The support may be formed from diatomaceous earth, kieselguhr, kaolin, alumina, zirconia, or the like. In an exemplary embodiment, the catalyst comprises a carbon-containing support, such as, for example, charcoal that has been thermally and/or chemically treated to yield a highly porous structure similar to activated carbon. The active catalyst component(s) may be added to the support in any suitable manner, as by impregnation by dipping, followed by drying. In an exemplary embodiment, Merox No. 8, Merox No. 10, Merox No. 21, or Merox No. 31, which are all commercially available from UOP LLC in Des Plaines, Ill., may comprise the active catalyst component(s). The mercaptan catalyst may comprise the active catalyst component impregnated on a support such as carbon.

The demercaptanized naphtha stream in line 114 may be fed to the light stripper column 120. The light stripper column 120 may be in downstream communication with the mercaptan oxidation reactor 112 to provide a light stripper bottoms stream comprising disulfides and olefins in line 128. In an aspect, the light stripper bottoms stream predominantly comprises disulfides. In various embodiments, the demercaptanized naphtha stream in line 114 may be stripped in the presence of an inert stripping medium. In accordance with an exemplary embodiment as shown in the FIGURE, the demercaptanized naphtha stream in line 114 may be passed through a demercaptan heat exchanger 116 to be heated by heat exchange with the hydrodesulfurized naphtha stream in line 146 before being fed to the light stripper column 120. The demercaptanized naphtha stream in line 114 may be stripped in the light stripper column 120 to provide a treated light naphtha stream in line 124 and a light stripper bottoms stream in line 128. In accordance with an instant embodiment as discussed, the treated light naphtha stream may be recovered from an overhead of the light stripper column 120 in line 124. An overhead stream from the light stripper column 120 may be condensed and separated in a receiver with a net overhead gas being taken out in line 126 and a portion of the condensed liquid being refluxed back to the light stripper column 120 to obtain another portion of the condensed liquid in the treated light naphtha stream in line 124. The net overhead gas may be taken out in line 126 from the receiver and may be passed to an off-gas scrubber (not shown). In an aspect, the cut-point of the treated light naphtha stream in the light stripper column 120 may be in range of about 60° C. (140° F.) to about 70° C. (158° F.) such that light stripper bottoms stream in line 128 predominantly comprises disulfides.

Referring back to the naphtha splitter column 106, the heavy naphtha stream in the naphtha splitter bottoms line 110 may be passed to a hydrodesulfurization reactor 144 to hydrodesulfurize the heavy naphtha stream. Accordingly, the heavy naphtha stream in naphtha splitter bottoms line 110 bypasses the mercaptan oxidation reactor 112. Consequently, the mercaptan oxidation reactor 112 is out of communication with naphtha splitter bottoms line 110. In accordance with an exemplary embodiment as shown in the FIGURE, the heavy naphtha stream in naphtha splitter bottoms line 110 passes through a surge drum 130, a first heavy heat exchanger 132 and a second heavy heat exchanger 134 and the di-olefin saturation reactor 136 before being passed to the hydrodesulfurization reactor 144. In accordance with an exemplary embodiment, the first heavy heat exchanger 132 may be a start-up heat exchanger which may be used only to heat the incoming feed from the naphtha splitter 106 during start-up phase. In an aspect, a steam stream may be used for heat exchange with the heavy naphtha stream in naphtha splitter bottoms line 110 to heat the heavy naphtha stream in the first heavy heat exchanger 132. Further, the heavy naphtha stream is heat exchanged with a hydrodesulfurized naphtha stream in line 146 in the second heavy heat exchanger 134 to heat the heavy naphtha stream.

The di-olefin saturation reactor 136 selectively hydrogenates the diolefins present in the heavy naphtha stream while minimizing mono-olefin hydrogenation. One non-limiting exemplary selective hydrogenation catalyst comprises a metal oxide on alumina. The metals are preferably selected from Group VIII and Group VI in the Periodic Table and may include nickel and molybdenum. The di-olefin saturation reactor 136 may have an operating temperature in the range of 140° to 210° C. and pressure is in the range of 25 to 30 $kg/cm^2$ g. In various embodiments, make-up hydrogen in line 135 may be added to the heavy naphtha stream before being fed to the di-olefin saturation reactor 136. A selectively hydrogenated heavy naphtha stream in line 138 may be withdrawn from the di-olefin saturation reactor 136 and mixed with the light stripper bottoms stream in line 128 to provide a mixed stream in line 140.

The mixed stream in line 140 may be passed to the hydrodesulfurization reactor 144 to hydrodesulfurize the mixed stream. In an alternative embodiment, the light stripper bottoms stream in line 128 may be passed to an inlet of the di-olefin saturation reactor 136, be selectively hydrogenated with the heavy naphtha stream to provide the selectively hydrogenated heavy naphtha stream in line 138, and subsequently passed to the hydrodesulfurization reactor 144, but this embodiment is not shown in the FIGURE. Nevertheless, the hydrodesulfurization reactor 144 may be in downstream communication with the light stripper column 120, the naphtha splitter bottoms line 128 and the di-olefin saturation reactor 136. In accordance with an exemplary embodiment as shown in the FIGURE, the mixed stream in line 140 may pass through a charge heater 142 which may comprise a fired heater before being passed to the hydrodesulfurization reactor 144. In one alternative unshown embodiment, the light stripper bottoms stream in line 128 may bypass the charge heater 142 and be fed to the hydrodesulfurization reactor 144 separately from the selectively the hydrogenated heavy naphtha stream in line 138. Accordingly, the light stripper bottoms stream in line 128 may be passed directly to the hydrodesulfurization reactor 144.

As shown in the FIGURE, the hydrodesulfurization reactor 144 may include two beds 144*a* and 144*b* of a hydrodesulfurization catalyst. More or less beds of hydrodesulfurization catalyst are contemplated in the hydrodesulfurization reactor 144. In accordance with various embodiments, hydrogen from a hydrogen recycle stream in line 168 may be added to the mixed stream in line 140 or any stream feeding the hydrodesulfurization reactor 144 prior to introduction to the hydrodesulfurization reactor 144.

A number of reactions take place in the hydrodesulfurization reactor 144 including hydrodesulfurization of mercaptans and other sulfur compounds that are present in the naphtha fractions. Examples of sulfur compounds that may be present include dimethyl sulfide, thiophenes, benzothiophenes, disulfides and the like. Preferably, the reactions in the hydrodesulfurization reactor 144 are selective to hydrodesulfurization; whereas, hydrogenation of olefins is minimized. The hydrodesulfurization reaction occurs typically in the presence of a catalyst consisting of an alumina base impregnated with cobalt and molybdenum. The organic sulfur compounds present in the heavy naphtha stream and the light stripper bottoms steam are converted by the hydrodesulfurization reaction to hydrogen sulfide. A hydrodesulfurized naphtha stream in line 146 may be withdrawn from the hydrodesulfurization reactor 144. Generally speaking, the hydrodesulfurized naphtha stream in line 146 may be passed to the heavy stripper column 122 to provide a heavy stripper overhead stream in a heavy stripper overhead line 159 and a treated heavy naphtha stream in line 160. Accordingly, the heavy stripper column 122 may be in downstream communication with the hydrodesulfurization reactor 144.

More specifically, the hydrodesulfurized naphtha stream in line 146 may pass through the second heavy heat exchanger 134 and the demercaptan heat exchanger 116 to cool the hydrodesulfurized naphtha stream before being fed to the separator 150. The hydrodesulfurized naphtha stream in line 146 may be heat exchanged with the heavy naphtha stream in the naphtha splitter bottoms line 110 in the second heavy heat exchanger 134 and may be heat exchanged with the demercaptanized naphtha stream in line 114 in the demercaptan heat exchanger 116. Additionally, the hydrodesulfurized naphtha stream in line 146 may pass through an air cooler 148 before being passed to the separator 150. A liquid hydrodesulfurized naphtha stream in a separator bottoms line 154 is withdrawn from the separator 150. A vaporous separator overhead stream in a separator overhead line 152, an aqueous sour stream from a boot in line 156 and the liquid hydrodesulfurized naphtha stream in the separator bottoms line 154 may be removed from the separator 150. The liquid hydrodesulfurized naphtha stream may be passed to the heavy stripper column 122. In accordance with an exemplary embodiment as shown in the FIGURE, the liquid hydrodesulfurized naphtha stream in the separator bottoms line 154 may be passed through a stripper heat exchanger 158 and be heated by heat exchange naphtha stream 160 before being fed to the heavy stripper column 122. In the heavy stripper column 122, the hydrodesulfurized naphtha stream may be fractionated to provide the heavy stripper overhead stream in line 159 and the treated heavy naphtha stream in line 160. The treated heavy naphtha stream in line 160 may be cooled by heat exchange with the liquid hydrodesulfurized naphtha stream in the separator bottoms line 154 in the heat exchanger 158.

Referring back to the separator 150, the vaporous separator overhead stream in the separator overhead line 152 may be passed to the scrubber column 162 or other treatment unit, in which it may be treated in any conventional manner to remove acid gases such as hydrogen sulfide present in the vaporous separator overhead stream in the separator overhead line 152. The scrubber column 162 may be utilized without a condenser on an overhead of the column and a reboiler at a bottom of the column. A lean amine stream in line 164 may be introduced to the scrubber column 162 for absorbing acid gases from the vaporous separator overhead stream in line 152. The hydrogen recycle stream in line 168 may be withdrawn from the amine scrubber column 162 and be recycled to the hydrodesulfurization reactor 144. In an aspect, a portion of the hydrogen recycle stream may be introduced between the first hydrodesulfurization catalyst bed 144*a* and the second hydrodesulfurization catalyst bed 144*b*, in line 174. In an exemplary embodiment as shown in the FIGURE, a make-up hydrogen stream in line 170 may be mixed with the hydrogen recycle stream in line 168. The hydrogen recycle stream in line 168 may pass through a compressor 172 before being passed to the hydrodesulfurization reactor 144. Furthermore, an amine enriched stream in line 166 may be withdrawn from the amine scrubber column 162.

Referring back to the heavy stripper column 122, the heavy stripper overhead stream in line 159 may be passed to the light stripper column 120. The heavy stripper overhead stream in line 159 may serve as a stripping medium to strip the demercaptanized naphtha stream in line 114 and provide the light stripper bottoms stream in line 128 comprising disulfides. Alternatively, in various embodiments, an inert vapor stream such as steam may be used as the stripping medium for stripping the demercaptanized naphtha stream. In other embodiments, the light stripper column 120 may only have a reboiler at the bottom of the column to vaporize and send a vaporized portion of light stripper bottoms stream back to the bottom of the light stripper column. The treated heavy naphtha stream in line 160 and the treated light naphtha stream in line 124 from the vessel 118 may be combined to provide a product stream in product line 176 having a lower sulfur content as compared to the hydrocarbon stream in line 102. The product stream in product line 176 may be passed for blending to the gasoline pool.

EXAMPLE

The following is an example of the process for sweetening of naphtha boiling range hydrocarbons, in accordance with an exemplary embodiment, that is similarly configured to the process and apparatus 100 illustrated in the FIGURE. The example is provided for illustration purposes only and is not meant to limit the various embodiments of processes and apparatuses for sweetening of naphtha boiling range hydrocarbons in any way.

An exemplary case study was conducted to understand the impact of the instant process scheme compared to a conventional scheme on final product properties. The instant process scheme has a mercaptan oxidation reactor on the overhead of the naphtha splitter and a light stripper column and a heavy stripper column. The conventional scheme has a mercaptan oxidation reactor upstream of a naphtha splitter column and only a single, heavy stripper column. The feed properties and product properties are provided in Table 1. Due to the change in flow scheme, hydrodesulfurization reactor feed properties will differ. Furthermore, the treated light naphtha stream and the treated heavy naphtha stream product properties are provided in Table 2 and the combined product properties are provided in Table 3.

TABLE 1

| Feed Properties | |
|---|---|
| Fresh Feed | |
| Olefins, wt % | 38.1 |
| RON | 99.2 |
| Sulfur, wppm | 692 |
| Hydrodesulfurization Reactor Feed | |
| Olefins, wt % | 15.1 |
| RON | 97.9 |
| Sulfur, wppm | 1334 |

TABLE 2

| Product Properties | Conventional Scheme | Instant Process Scheme |
|---|---|---|
| Treated Light Naphtha to Blending, Line 124 | | |
| Olefins, wt % | 62.6 | 62.6 |
| RON | 100.3 | 100.3 |
| Sulfur, wppm | 9.4 | 9.5 |
| Treated Heavy Naphtha from Hydrodesulfurization reactor, Line 160 | | |
| Olefins, wt % | 7.98 | 7.98 |
| RON | 96.2 | 96.2 |
| Sulfur, wppm | 19.3 | 19.3 |

TABLE 3

| Combined Product Properties (Treated Light Naphtha and Treated Heavy Naphtha) | | |
|---|---|---|
| Combined Final Product | Conventional Scheme | Instant Process Scheme |
| Olefins, wt % | 34.46 | 34.45 |
| RON | 98.45 | 98.45 |
| Sulfur, wppm | 14.4 | 14.5 |

In Table 4 below, Capital expenditure for the Instant Flow Scheme is compared with Conventional Scheme:

TABLE 4

| Reduction in Capital Expense | Conventional Scheme | Instant Flow Scheme |
|---|---|---|
| Capital Expenditure | $3,200,000 | $2,514,565 |

The cost of the revamp for the two cases is illustrated in Table 4 above. The capacity decreased because the mercaptan oxidation unit in the Instant Flow Scheme processed only light naphtha as compared to full range naphtha in the Conventional Scheme. The capital expense savings with the Conventional Scheme having a mercaptan oxidation unit upstream of the naphtha splitter column and only having a heavy stripper column is compared with the Instant Flow Scheme having a smaller mercaptan oxidation unit downstream of the naphtha splitter column and a new light stripper column stacked with the heavy stripper column equals US $685,435, hence resulting in significant savings using the Instant Flow Scheme. The large savings in capital expense would be reduced slightly if the light stripper column and they heavy stripper column were not located in the same vessel.

SPECIFIC EMBODIMENTS

While the following is described in conjunction with specific embodiments, it will be understood that this description is intended to illustrate and not limit the scope of the preceding description and the appended claims.

A first embodiment of the invention is a process for treating a naphtha stream from a FCC unit, wherein the process comprises reacting a light naphtha stream in a mercaptan oxidation reactor to provide a demercaptanized naphtha stream; and stripping the demercaptanized naphtha stream in a light stripper column to provide a treated light naphtha stream and a bottoms stream. An embodiment of the invention is one, any or all of prior embodiments in this paragraph up through the first embodiment in this paragraph further comprising providing an alkaline stream to the light naphtha stream to the mercaptan oxidation reactor, wherein the alkaline stream comprises one of caustic or ammonia. An embodiment of the invention is one, any or all of prior embodiments in this paragraph up through the first embodiment in this paragraph further comprising passing a full range naphtha stream to a naphtha splitter column to provide the light naphtha stream and a heavy naphtha stream. An embodiment of the invention is one, any or all of prior embodiments in this paragraph up through the first embodiment in this paragraph further comprising passing the heavy naphtha stream and the bottoms stream from the light stripper column to a hydrodesulfurization reactor to hydrodesulfurize the heavy naphtha stream and the bottoms stream. An embodiment of the invention is one, any or all of prior embodiments in this paragraph up through the first embodiment in this paragraph further comprising passing the heavy naphtha stream through a di-olefin saturation reactor prior to passing the heavy naphtha stream through the hydrodesulfurization reactor. An embodiment of the invention is one, any or all of prior embodiments in this paragraph up through the first embodiment in this paragraph further comprising passing a hydrodesulfurized naphtha stream from the hydrodesulfurization reactor to a heavy stripper column to provide a heavy stripper overhead stream and a treated heavy naphtha stream. An embodiment of the invention is one, any or all of prior embodiments in this paragraph up through the first embodiment in this paragraph further comprising passing the heavy stripper overhead stream to the light stripper column. An embodiment of the invention is one, any or all of prior embodiments in this paragraph up through the first embodiment in this paragraph further comprising passing a hydrodesulfurized naphtha stream from the hydrodesulfurization reactor to a separator to provide a liquid hydrodesulfurized naphtha stream and passing the liquid hydrodesulfurized naphtha stream to the heavy stripper column to provide the heavy stripper overhead stream and the treated heavy naphtha stream.

A second embodiment of the invention is a process for treating a naphtha stream from a FCC unit, wherein the process comprises passing the naphtha stream to a naphtha splitter column to provide a light naphtha stream and a heavy naphtha stream; reacting the light naphtha stream in a mercaptan oxidation reactor to provide a demercaptanized naphtha stream; and stripping the demercaptanized naphtha stream in a light stripper column to provide a treated light naphtha stream and a bottoms stream. An embodiment of the invention is one, any or all of prior embodiments in this paragraph up through the second embodiment in this paragraph further comprising providing an alkaline stream to the light naphtha stream to the mercaptan oxidation reactor, wherein the alkaline stream comprises one of caustic or ammonia. An embodiment of the invention is one, any or all of prior embodiments in this paragraph up through the second embodiment in this paragraph further comprising passing the heavy naphtha stream and the bottoms stream from the light stripper column to a hydrodesulfurization reactor to hydrodesulfurize the heavy naphtha stream and the bottoms stream. An embodiment of the invention is one, any or all of prior embodiments in this paragraph up through the second embodiment in this paragraph further comprising passing the heavy naphtha stream through a di-olefin saturation reactor prior to passing the heavy naphtha stream through the hydrodesulfurization reactor. An embodiment of the invention is one, any or all of prior embodiments in this paragraph up through the second embodiment in this paragraph further comprising passing a hydrodesulfurized naphtha stream from the hydrodesulfurization reactor to a heavy stripper column to provide a heavy stripper overhead stream and a treated heavy naphtha stream. An embodiment of the invention is one, any or all of prior embodiments in this paragraph up through the second embodiment in this paragraph further comprising passing a hydrodesulfurized naphtha stream from the hydrodesulfurization reactor to a separator to provide a liquid hydrodesulfurized naphtha stream and passing the liquid hydrodesulfurized naphtha stream to the heavy stripper column to provide the heavy stripper overhead stream and the treated heavy naphtha stream.

A third embodiment of the invention is an apparatus for treating a naphtha stream from a FCC unit, wherein the apparatus comprises a mercaptan oxidation reactor to provide a demercaptanized naphtha stream; and a light stripper column in downstream communication with the mercaptan oxidation reactor to provide a light stripper bottoms stream. An embodiment of the invention is one, any or all of prior embodiments in this paragraph up through the third embodiment in this paragraph further comprising a naphtha splitter column to provide a light naphtha stream in a naphtha splitter overhead line and a heavy naphtha stream in a naphtha splitter bottoms line, wherein the mercaptan oxidation reactor in downstream communication with the naphtha splitter column. An embodiment of the invention is one, any or all of prior embodiments in this paragraph up through the third embodiment in this paragraph further comprising a hydrodesulfurization reactor in downstream communication with the light stripper column and the naphtha splitter bottoms line to provide a hydrodesulfurized naphtha stream. An embodiment of the invention is one, any or all of prior embodiments in this paragraph up through the third embodiment in this paragraph further comprising a heavy stripper column in downstream communication with the hydrodesulfurization reactor to provide a heavy stripper overhead stream in a heavy stripper overhead line. An embodiment of the invention is one, any or all of prior embodiments in this paragraph up through the third embodiment in this paragraph, wherein the light stripper column is in downstream communication with the heavy stripper overhead line. An embodiment of the invention is one, any or all of prior embodiments in this paragraph up through the third embodiment in this paragraph, wherein the light stripper column and the heavy stripper column are stacked in a single vessel.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for treating a naphtha stream from a FCC unit, wherein the process comprises:

reacting a light naphtha stream in a mercaptan oxidation reactor to provide a demercaptanized naphtha stream; and stripping the demercaptanized naphtha stream in a light stripper column to provide a treated light naphtha stream and a bottoms stream.

2. The process of claim 1 further comprising providing an alkaline stream to the light naphtha stream to the mercaptan oxidation reactor, wherein the alkaline stream comprises one of caustic or ammonia.

3. The process of claim 1 further comprising passing a full range naphtha stream to a naphtha splitter column to provide the light naphtha stream and a heavy naphtha stream.

4. The process of claim 3 further comprising passing the heavy naphtha stream and the bottoms stream from the light stripper column to a hydrodesulfurization reactor to hydrodesulfurize the heavy naphtha stream and the bottoms stream.

5. The process of claim 4 further comprising passing the heavy naphtha stream through a di-olefin saturation reactor prior to passing the heavy naphtha stream through the hydrodesulfurization reactor.

6. The process of claim 4 further comprising passing a hydrodesulfurized naphtha stream from the hydrodesulfurization reactor to a heavy stripper column to provide a heavy stripper overhead stream and a treated heavy naphtha stream.

7. The process of claim 6 further comprising passing the heavy stripper overhead stream to the light stripper column.

8. The process of claim 4 further comprising passing a hydrodesulfurized naphtha stream from the hydrodesulfurization reactor to a separator to provide a liquid hydrodesulfurized naphtha stream and passing the liquid hydrodesulfurized naphtha stream to the heavy stripper column to provide the heavy stripper overhead stream and the treated heavy naphtha stream.

9. A process for treating a naphtha stream from a FCC unit, wherein the process comprises:

passing the naphtha stream to a naphtha splitter column to provide a light naphtha stream and a heavy naphtha stream;

reacting the light naphtha stream in a mercaptan oxidation reactor to provide a demercaptanized naphtha stream; and stripping the demercaptanized naphtha stream in a light stripper column to provide a treated light naphtha stream and a bottoms stream.

10. The process of claim 9 further comprising providing an alkaline stream to the light naphtha stream to the mercaptan oxidation reactor, wherein the alkaline stream comprises one of caustic or ammonia.

11. The process of claim 9 further comprising passing the heavy naphtha stream and the bottoms stream from the light stripper column to a hydrodesulfurization reactor to hydrodesulfurize the heavy naphtha stream and the bottoms stream.

12. The process of claim 11 further comprising passing the heavy naphtha stream through a di-olefin saturation reactor prior to passing the heavy naphtha stream through the hydrodesulfurization reactor.

13. The process of claim 11 further comprising passing a hydrodesulfurized naphtha stream from the hydrodesulfurization reactor to a heavy stripper column to provide a heavy stripper overhead stream and a treated heavy naphtha stream.

14. The process of claim 11 further comprising passing a hydrodesulfurized naphtha stream from the hydrodesulfurization reactor to a separator to provide a liquid hydrodesulfurized naphtha stream and passing the liquid hydrodesulfurized naphtha stream to the heavy stripper column to provide the heavy stripper overhead stream and the treated heavy naphtha stream.

* * * * *